United States Patent [19]

Ruegsegger

[11] 4,098,318

[45] Jul. 4, 1978

[54] CURTAIN EDGE RETAINER

[76] Inventor: Ted W. Ruegsegger, 533 Longwood Ave., Glencoe, Ill. 60022

[21] Appl. No.: 784,661

[22] Filed: Apr. 5, 1977

[51] Int. Cl.[2] ..... A47H 23/00; E06B 3/80

[52] U.S. Cl. ..... 160/327; 160/349 D

[58] Field of Search ..... 160/327, 349 R, 349 D; 4/149, 153, 154

[56] References Cited

U.S. PATENT DOCUMENTS

| | | | |
|---|---|---|---|
| 1,172,174 | 2/1916 | Soule | 160/327 |
| 2,303,502 | 12/1942 | Rous | 160/327 |
| 3,205,547 | 9/1965 | Riekse | 160/349 |
| 3,330,330 | 7/1967 | Sanderson | 160/327 |
| 3,879,806 | 4/1975 | Armstrong | 4/149 |

*Primary Examiner*—Peter M. Caun

*Attorney, Agent, or Firm*—Tilton, Fallon, Lungmus & Chestnut

[57] ABSTRACT

A curtain edge retainer for releasably securing a marginal edge portion of a pliant hanging curtain in position contiguous to a wall. The device includes an elongated flexible corner member, a latch member, an elongated rigid curtain stiffener, a clip member, and handle means. The corner member has a base strip attached in sealing engagement to the wall and a fastener strip attached to the base strip and projecting outwardly from the wall. The latch member is attached to the fastener strip and has a receiving portion facing away from the wall and a retaining portion adjacent the wall. The curtain stiffener is rolled within the marginal edge portion of the pliant hanging curtain with the curtain stiffener and the rolled marginal edge portion being adapted to be engaged with and disengage from the latch member. The clip member is attached to the curtain stiffener over the rolled marginal edge portion to hold the rolled marginal edge portion on the curtain stiffener. The handle means is operatively associated with the curtain stiffener. The device includes these elements either operatively associated with the curtain and the wall or as component parts of a kit capable of being assembled. With these features of construction, the curtain edge retainer is well suited for releasably securing a marginal edge portion of a pliant hanging curtain in position contiguous to a wall.

13 Claims, 10 Drawing Figures

CURTAIN EDGE RETAINER

BACKGROUND

This invention relates to a curtain edge retainer and, more particularly, to a curtain edge retainer for releasably securing a marginal edge portion of a pliant hanging curtain in position contiguous to a wall.

Many applications requiring a pliant hanging curtain could advantageously utilize a releasable securing means to hold a marginal edge portion. The use of such a device has previously been proposed with bathtubs to secure a shower curtain in a manner preventing water from escaping outside of the tub. An additional and similar use is with shower stalls where the same problems are presented and possibly to a greater degree due to the usual smaller size of such stalls and the consequent increased impingement of spraying water within the stall enclosure. The use of such a device may also be proposed with spray paint booths, public dressing rooms, private closet enclosures, or anywhere a pliant hanging curtain is used. While the desirability of a curtain edge retainer has long been known, prior attempts have fallen short of providing a device achieving the multiple goals of simple construction, easy installation and maximum versatility.

Most prior attempts have been directed solely to providing devices useful with bathtub enclosures. This type of device has been proposed as an alternative to common sliding doors that hamper the utility of the tub for other than shower purposes. For example, prior art devices of the type being discussed are disclosed in prior U.S. Pat. Nos. 3,879,806; 3,808,610; 3,639,919; 3,205,547; and 2,761,150. This prior art is, for the most part, complicated in construction, difficult to install and less than fully versatile. While recognizing the desirability of such devices, the prior art has simply failed to provide a curtain edge retainer of a type capable of achieving all of these goals.

While the prior art has attempted to deal with the problems associated with successfully providing a curtain edge retainer, the present invention provides a successful curtain edge retainer representing a distinct improvement over all such prior art constructions.

SUMMARY

The present invention is directed to a curtain edge retainer for releasably securing a marginal edge portion of a pliant hanging curtain in position contiguous to a wall. The device includes an elongated flexible corner member, a latch member, an elongated rigid curtain stiffener, a clip member, and handle means. The corner member has a base strip attached in sealing engagement to the wall and a fastener strip attached to the base strip and projecting outwardly from the wall. The latch member is attached to the fastener strip and has a receiving portion facing away from the wall and a retaining portion adjacent the wall. The curtain stiffener is rolled within the marginal edge portion of the pliant hanging curtain with the curtain stiffener and the rolled marginal edge portion being adapted to be engaged with and disengaged from the latch member. The clip member is attached to the curtain stiffener over the rolled marginal edge portion to hold the rolled marginal edge portion on the curtain stiffener. The handle means is operatively associated with the curtain stiffener. The device includes these elements either operatively associated with the curtain and the wall or as component parts of a kit capable of being assembled. With these features of construction, the curtain edge retainer is well suited for releasably securing a marginal edge portion of a pliant hanging curtain in position contiguous to a wall.

In a preferred embodiment, the fastener grip is integrally formed with the base strip at a right angle to define a unitary L-shaped corner member. The corner member is attached in sealing engagement to the wall with a pressure sensitive adhesive on the base strip. The base strip includes a thin tape thereon having the pressure sensitive adhesive on both sides thereof. The thin tape has a width and length the same as the width and length of the base strip. The latch member is a resilient C-shaped catch with the receiving portions defining a narrowed opening smaller in width than the width of the curtain stiffener leading to the retaining portion.

The curtain stiffener is a rod commensurate in length with the length of the corner member. The rod includes a pressure sensitive adhesive along and around at least a portion of the circumference thereof. The pressure sensitive adhesive holds the rolled marginal edge portion prior to attachment of the clip member. The clip member is a resilient C-shaped clasp having a narrowed opening smaller in width than the width of the curtain stiffener. The handle means is a clip handle member attached to the curtain stiffener over the rolled marginal edge portion.

With the features of the present invention, the curtain edge retainer can be provided as a kit having component parts capable of being assembled on site for releasably securing a marginal edge portion of an existing pliant hanging curtain contiguous to a wall. The kit includes the combination of an elongated flexible corner member, a pair of latch members, an elongated rigid curtain stiffener, a pair of clip members, and a clip handle member. The corner member has a base strip adapted to be attached in sealing engagement with a wall and a fastener strip integrally formed with and projecting outwardly from the base strip. The latch members are attached to the fastener strip in spaced relationship with each having a receiving portion facing away from the base strip and retaining portion adjacent the base strip. The curtain stiffener is adapted to be rolled within the marginal edge portion of the pliant hanging curtain with the curtain stiffener and the rolled marginal edge portion being adapted to be engaged with and disengaged from the latch members after the component parts have been assembled. The clip members are adapted to be attached to the curtain stiffener in spaced relationship over the rolled marginal edge portion to hold the rolled marginal edge portion on the curtain stiffener. The clip handle member is adapted to be attached to the curtain stiffener intermediate the clip members over the rolled marginal edge portion. The kit utilizes the clip handle member to move the curtain stiffener and the rolled marginal edge portion toward the latch members, through the receiving portions thereof, into the retaining portions thereof. With these features of construction, the curtain edge retainer kit is well suited for releasably securing a marginal edge portion of an existing pliant hanging curtain contiguous to a wall after its component parts have been assembled.

It is therefore an object of the present invention to provide a curtain edge retainer and kit which can be assembled and used for releasably securing a marginal edge portion of a pliant hanging curtain contiguous to a wall. The present invention accomplishes this objective with a unique combination of elements that are simple to manufacture, easy to install, and provide maximum versatility in a wide range of suitable applications. The provision of the structure and the realization of the advantages to be derived therefrom constitute additional important objects of the present invention with still other objects of the present invention to be appreciated from a consideration of the details of construction and operation set forth in the accompanying specification, claims and drawings.

DRAWINGS

The invention is described in conjunction with the accompanying drawings, in which.

DESCRIPTION

Figures 1, 2, 3, 4, 5, 6, 7, 8, 9, 10:
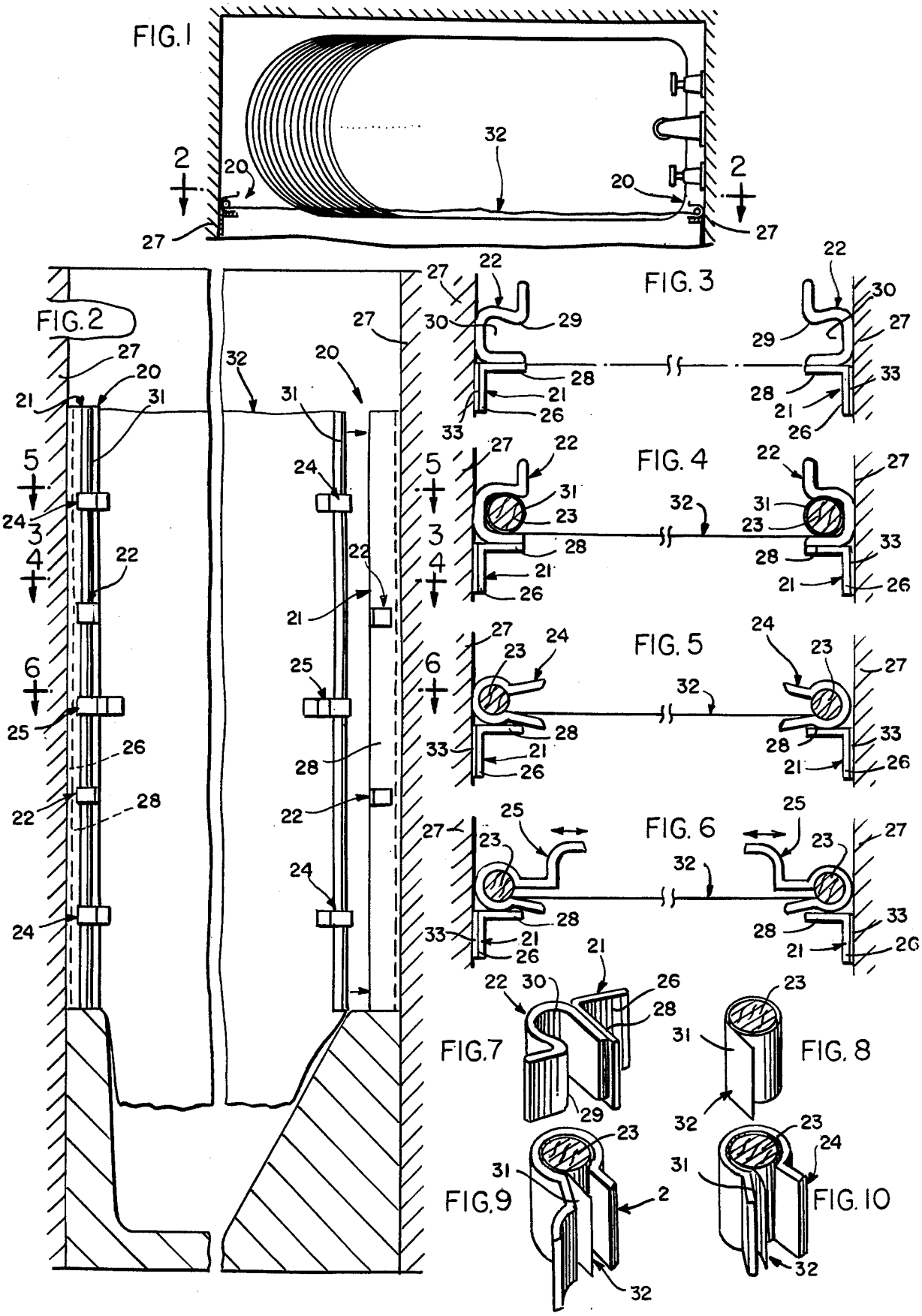
FIG. 1 is a plan view of a bathtub utilizing the curtain edge retainer for releasably securing a marginal edge portion of a pliant hanging curtain in position contiguous to a wall in accordance with the present invention.
FIG. 2 is a partial cross-sectional view taken on the line 2—2 of FIG. 1 illustrating the manner of use of the curtain edge retainer in accordance with the present invention.
FIG. 3 is a partial cross-sectional view taken on the line 3—3 of FIG. 2 without pliant hanging curtain illustrating the elongated flexible corner members and the latch members of the present invention.
FIG. 4 is a partial cross-sectional view taken on the line 4—4 of FIG. 2 with a pliant hanging curtain illustrating the elongated flexible corner members, the latch members, and the elongated rigid curtain stiffeners of the present invention.
FIG. 5 is a partial cross-sectional view taken on the line 5—5 of FIG. 2 with a pliant hanging curtain illustrating the elongated flexible corner members, the clip members, and the elongated rigid curtain stiffeners of the present invention.
FIG. 6 is a partial cross-sectional view taken on the line 6—6 of FIG. 2 with a pliant hanging curtain illustrating the elongated flexible corner members, the clip handle members, and the elongated rigid curtain stiffeners of the present invention.
FIG. 7 is a partial perspective view of the elongated flexible corner member and the latch member of the present invention.
FIG. 8 is a partial perspective view of the elongated rigid curtain stiffener and a marginal edge portion of a pliant hanging curtain of the present invention.
FIG. 9 is a partial perspective view of the elongated rigid curtain stiffener and a marginal edge portion of a pliant hanging curtain and the clip handle member of the present invention.
FIG. 10 is a partial perspective view of the elongated rigid curtain stiffener and a marginal edge portion of a pliant hanging curtain and the clip member of the present invention.

In the illustration given and with reference first to FIG. 2, the numeral 20 designates generally a curtain edge retainer for releasably securing a marginal edge portion of a pliant hanging curtain in position contiguous to a wall in accordance with the present invention. The curtain edge retainer 20 includes an elongated flexible corner member 21 (as shown in FIG. 4), a latch member 22, an elongated rigid curtain stiffener 23 (as shown in FIG. 5), a clip member 24, and handle means 25 (as shown in FIG. 6). The corner member 21 has a base strip 26 attached in sealing engagement to a wall 27 and a fastener strip 28 attached to the base strip 26 and projecting outwardly from the wall 27. The latch member 22 is attached to the fastener strip 28 (as shown in FIG. 7) and has a receiving portion 29 facing away from the wall 27 and a retaining portion 30 adjacent the wall 27. The curtain stiffener 23 is rolled within a marginal edge portion 31 of a pliant hanging curtain 32 with the curtain stiffener 23 and the rolled marginal edge portion 31 being adapted to be engaged with and disengaged from the latch member 22. The clip member 24 is attached to the curtain stiffener 23 over the rolled marginal edge portion 31 (as shown in FIG. 10) to hold the rolled marginal edge portion 31 on the curtain stiffener 23. The handle means 25 is operatively associated with the curtain stiffener 23. The curtain edge retainer 20 includes these elements either operatively associated with the curtain 32 and the wall 27 or as component parts of a kit capable of being assembled. With these features of construction, the curtain edge retainer 20 is well suited for releasably securing the marginal edge portion 31 of the pliant hanging curtain 32 in position contiguous to the wall 27.

Referring to FIGS. 3 through 7, the fastener strip 28 is integrally formed with the base strip 26 at a right angle to define a unitary L-shaped corner member 21. The corner member 21 is attached in sealing engagement to the wall 27 with a pressure sensitive adhesive on the base strip 26. The base strip 26 includes a thin tape 33 thereon having the pressure sensitive adhesive on both sides thereof. The thin tape 33 which is preferably a double faced foam tape has a width and length the same as the width and length of the base strip 26. The latch member 22 is a resilient C-shaped catch with the receiving portion 29 defining a narrowed opening smaller in width than the width of the curtain stiffener 23 (as shown in FIG. 4) leading to the retaining portion 30.

The curtain stiffener 23 is a rod commensurate in length with the length of the corner member 21 (as shown in FIG. 2). The rod 23 includes a pressure sensitive adhesive along and around at least a portion of the circumference thereof. The pressure sensitive adhesive which can preferably be provided by using a double faced tape holds the rolled marginal edge portion 31 prior to attachment of the clip member 24. The clip member 24 is a resilient C-shaped clasp having a narrowed opening smaller in width than the width of the curtain stiffener 23 (as shown in FIG. 10). The handle means 25 is a clip handle member attached to the curtain stiffener 23 over the rolled marginal edge portion 31 (as shown in FIG. 9).

With the features of the present invention, the curtain edge retainer 20 can be provided as a kit having component parts capable of being assembled on site for releasably securing a marginal edge portion 31 of an existing pliant hanging curtain 32 contiguous to a wall 27. The kit includes the combination of an elongated flexible corner member 21, a pair of latch members 22, an elongated rigid curtain stiffener 23, a pair of clip members 24, and a clip handle member 25. The corner member 21 has a base strip 26 adapted to be attached in sealing engagement with a wall 27 and a fastener strip 28 integrally formed with and projecting outwardly from the base strip 26. The latch members 22 are attached to the fastener strip 28 in spaced relationship with each having a receiving portion 29 facing away from the base strip 26 and a retaining portion 30 adjacent the base strip 26. The curtain stiffener 23 is adapted to be rolled within the marginal edge portion 31 of the pliant hanging curtain 32 with the curtain stiffener 23 and the rolled marginal edge portion 31 being adapted to be engaged with and disengaged from the latch members 22 after the component parts have been assembled. The clip members 24 are adapted to be attached to the curtain stiffener 23 in spaced relationship over the rolled marginal edge portion 31 to hold the rolled marginal edge portion 31 on the curtain stiffener 23. The clip handle member 25 is adapted to be attached to the curtain stiffener 23 intermediate the clip members 24 over the rolled marginal edge portion 31. The kit utilizes the clip handle member 25 to move the curtain stiffener 23 and the rolled marginal edge portion 31 toward the latch members 22, through the receiving portions 29 thereof, into the retaining portions 30 thereof. With these features of construction, the curtain edge retainer kit is well suited for releasably securing a marginal edge portion 31 of an existing pliant hanging curtain 32 contiguous to a wall 27 after its component parts have been assembled.

With the curtain edge retainer kit of the present invention, a bathtub or shower stall can be converted to a leak-proof enclosure using an existing pliant hanging curtain. A corner member 21 is attached in sealing engagement to a wall 27. This is done by utilizing the high tack, double faced foam tape 33 having pressure sensitive adhesive on both sides thereof. The tape is very thin having a width and length the same as the width and length of the base strip 26. This pressure sensitive adhesive is preferably a type whose adhesive qualities are not significantly affected by water or steam. With the flexible nature of the corner member 21, the base strip 26 closely conforms to the surface of the wall 27 even if the wall 27 has an uneven contour such as with ceramic tile joints. This is important to assure that the corner member 21 is attached in sealing engagement to the wall 27 to prevent leakage of water and loosening of the adhesion of the pressure sensitive adhesive on the thin tape 33. The base strip 26 and the fastener strip 28 are preferably arranged so that the fastener strip 28 is disposed inwardly toward the enclosure along a line defined by the inner edge of the outwardly facing side of the bathtub or shower stall. This is done so that water contacting the corner defined by the fastener strip 28 and the wall 27 will run downwardly into the bathtub or shower stall remaining within the enclosure. A pair of latch members 22 previously attached to the fastener strip 28 in spaced relationship are disposed on the side of the fastener strip 28 opposite the base strip 26 so that the receiving portion 29 of each faces away from the wall 27 and the retaining portion 30 of each is adjacent the wall 27. When the corner member 21 composed of the base strip 26, fastener strip 28, and pair of latch members 22 have been attached in sealing engagement to the wall 27 in the manner described, the remaining component parts of the curtain edge retainer kit can be assembled.

Referring to FIG. 8, the curtain stiffener 23 is rolled within the marginal edge portion 31 of the existing pliant hanging curtain 32. This is aided by the fact that the rod 23 includes a double faced tape along and around at least a portion of the circumference thereof. As a result, the rolled marginal edge portion 31 is easier to roll on the curtain stiffener 23 since it is held in position by the double faced tape prior to attachment of the clip members 24. This is followed by attachment of the clip members 24 (as shown in FIG. 10) in spaced relationship over the rolled marginal edge portion 31 staggered relative to the position of the latch members 22 on the corner member 21 to permanently hold the rolled marginal edge 31 on the rod 23. As a final step, the clip handle member 25 is attached to the curtain stiffener 23 intermediate the clip members 24 over the rolled marginal edge portion 31 (as shown in FIG. 9). This permits the rod 23 and the rolled marginal edge portion 31 to be moved toward the latch members 22, through the receiving portions 29 thereof, and into the retaining portions 30 thereof (as shown in FIG. 4). When the component parts have been so assembled, the curtain edge retainer kit is well suited for releasably securing the marginal edge portion 31 of the existing pliant hanging curtain contiguous to the wall 27.

Referring to FIGS. 1 through 6, I have found it advantageous to provide a curtain edge retainer 20 for releasably securing both marginal edge portions 31 of a pliant hanging curtain 32 in position contiguous to opposite walls 27. The kit in this event is provided with exactly double the number of component parts described above. It will include a pair of elongated flexible corner members 21, two pair of latch members 22, a pair of elongated rigid curtain stiffeners 23, two pairs of clip members 24, and a pair of clip handle members 25. The assembly of each of the curtain edge retainers 20 at each end of the enclosure will be as described above. While I have found it advantageous to releasably secure both marginal edge portions 31 of a pliant hanging curtain 32 contiguous to opposite walls 27, it will be appreciated that only one marginal edge portion of the pliant hanging curtain can be secured in the event that only one curtain edge retainer 20 is used.

Referring again to FIGS. 1 and 2, the operation of the curtain edge retainer 20 can be understood. The curtain edge retainer 20 is shown in FIG. 1 releasably securing both marginal edge portions 31 of a pliant hanging curtain 32 in a position contiguous to opposite walls 27. This clearly demonstrates that the present invention makes it possible to convert a bathtub or shower stall to a leakproof enclosure. Any water impinging upon either of the marginal edge portions 31 contiguous to the opposite walls 27 will run down along the fastener strip 28 and the walls 27 into the tub or stall. This is further aided by the fact that the base strip 26 is attached in sealing engagement to the wall 27. The spraying water impinging on the marginal edge portions 31 therefore cannot escape from the tub or stall. As a result, the bathtub or shower stall as the case may be has successfully been converted into a leak-proof enclosure by reason of utilization of curtain edge retainers 20.

After a person has completed a shower within the tub, one of the clip handle members 25 can be used to move the corresponding curtain stiffener 23 and the corresponding rolled marginal edge portion 31 away from the corresponding latch members 22, out of the retaining portions 30 thereof and through the receiving portions 29 thereof. This is easily done since the latch members 22 are resilient and the pliant hanging curtain 32 can then be drawn back so that the person can step out of the tub. The other clip handle member 25 associated with the other marginal edge portion 31 can also be used to release the other marginal edge portion 31 of the pliant hanging curtain 32 contiguous to the other wall 27 and the pliant hanging curtain 32 can be placed outside of the bathtub for use of the tub without the shower. This procedure is, of course, reversed (as shown in FIG. 2) for later use of the tub to again convert it to a leak-proof enclosure.

With the present invention, a curtain edge retainer and kit are provided which can be assembled and used for releasably securing a marginal edge portion of a pliant hanging curtain contiguous to a wall. It is particularly advantageous for use with any existing pliant hanging curtain in a wide range of applications. This encompasses such uses as with bathtubs, shower stalls, spray paint booths, public dressing rooms, private closet enclosures, or anywhere a pliant hanging curtain is used. It is desirable because it makes it possible to change curtains at will by merely transferring the rod, clip members, and handle means from the old curtain to the new curtain without having to replace the curtain edge retainer itself. The present invention has the ability to releasably secure a marginal edge portion of the pliant hanging curtain contiguous to a wall because of its unique structural and functional features.

My curtain edge retainer and kit is also highly advantageous for applications such as nursing homes and hospitals. It is generally known and accepted that bathtubs and shower stalls cannot have doors in such institutions. The motivating factor for this requirement is safety and also because the enclosures are usually designed so that a patient can be transported into the enclosure in a wheel chair. It is also desirable for such institutions to use clip handle members having a handle portion on both the inside and outside rather than only on the inside as shown in the drawings. While I have not shown a handle of this type, I believe the modification required to be readily apparent.

The present invention makes it possible to convert a bathtub to a leak-proof enclosure for showers without the disadvantages associated with permanently mounted folding or sliding doors. It has been found that doors of the type mentioned seriously detract from the use of the enclosure as a bathtub. My curtain edge retainer also may find use in the recreational vehicle field and in boats where it is imperative for the marginal edge portions of curtains on shower stalls to be releasably secured in position contiguous to the walls. It is therefore useful in a myriad of diverse applications due to its many advantageous features. The present invention clearly provides a curtain edge retainer that accomplishes the multiple goals of providing a device characterized by simple construction, easy installation, and maximum versatility.

While in the foregoing specification a detailed description of the invention has been set forth for purposes of illustration, variations of the details herein given may be made by those skilled in the art without departing from the spirit and scope of the invention.

I claim:

1. A curtain edge retainer for releasably securing a marginal edge portion of a pliant hanging curtain in position contiguous to a wall comprising an elongated flexible corner member having a base strip attached in sealing engagement to said wall and a fastener strip attached to said base strip and projecting outwardly from said wall, a latch member attached to said fastener strip and having a receiving portion facing away from said wall and a retaining portion adjacent said wall, an elongated rigid curtain stiffener rolled within said marginal edge portion of said pliant hanging curtain, said elongated rigid curtain stiffener and said rolled marginal edge portion adapted to be engaged with and disengaged from said latch member, a clip member attached to said elongated rigid certain stiffener over said rolled marginal edge portion to hold said rolled marginal edge portion on said elongated rigid curtain stiffener, and handle means operatively associated with said elongated rigid curtain stiffener whereby said marginal edge portions of said pliant hanging curtain can be releasably secured in position contiguous to said wall.

2. The curtain edge retainer of claim 1 in which said fastener strip is attached to said base strip at a right angle to define an L-shaped elongated flexible corner member.

3. The curtain edge retainer of claim 2 in which said fastener strip is integrally formed with said base strip to define a unitary elongated flexible corner member.

4. The curtain edge retainer of claim 1 in which said base strip is attached in sealing engagement to said wall with a pressure sensitive adhesive.

5. The curtain edge retainer of claim 4 in which said base strip includes a thin tape thereon having said pressure sensitive adhesive on both sides thereof with said thin tape having a width and length the same as the width and length of said base strip.

6. The curtain edge retainer of claim 1 in which said latch member is C-shaped with said receiving portion defining a narrowed opening leading to said retaining portion.

7. The curtain edge retainer of claim 5 in which said latch member is resilient with said narrowed opening being smaller in width than the width of said elongated rigid curtain stiffener.

8. The curtain edge retainer of claim 1 in which said elongated rigid curtain stiffener is a rod being commensurate in length with the length of said elongated flexible corner member.

9. The curtain edge retainer of claim 8 in which said rod includes a pressure sensitive adhesive along and around at least a portion of the circumference thereof to hold said rolled marginal edge portion prior to attachment of said clip member.

10. The curtain edge retainer of claim 1 in which said clip member is C-shaped having a narrowed opening smaller in width than the width of said elongated rigid curtain stiffener.

11. The curtain edge retainer of claim 1 in which said handle means is a clip handle member attached to said elongated rigid curtain stiffener over said rolled marginal edge portion.

12. A curtain edge retainer kit having component parts capable of being assembled on site for releasably securing a marginal edge portion of a pliant hanging curtain contiguous to a wall comprising the combination of an elongated flexible corner member having a base strip adapted to be attached in sealing engagement with a wall and a fastener strip integrally formed with and projecting outwardly from said base strip, a pair of latch members attached to said fastener strip in spaced relationship, each of said latch members having a receiving portion facing away from said base strip and a retaining portion adjacent said base strip, an elongated rigid curtain stiffener adapted to be rolled within said marginal edge portion of said pliant hanging curtain, said elongated rigid curtain stiffener and said rolled marginal edge portion adapted to be engaged with and disengaged from said latch members after said component parts have been assembled, a pair of clip members adapted to be attached to said elongated rigid curtain stiffener in spaced relationship over said rolled marginal edge portion to hold said rolled marginal edge portion on said elongated rigid curtain stiffener, and a clip handle member adapted to be attached to said elongated rigid curtain stiffener intermediate said clip members over said rolled marginal edge portion, whereby said clip handle member can be used to move said elongated rigid curtain stiffener and said rolled marginal edge portion toward said latch members, through said receiving portions thereof, into said retaining portions thereof to releasably secure said marginal edge portion of said pliant hanging curtain contiguous to said wall after said component parts have been assembled.

13. The curtain edge retainer kit of claim 12 including a pair of elongated flexible corner members, two pairs of latch members, a pair of elongated rigid curtain stiffeners, two pairs of clip members, and a pair of clip handle members for releasably securing both marginal edge portions of said pliant hanging curtain in position contiguous with opposite walls.

* * * * *